US006463904B2

(12) United States Patent
Weindorf

(10) Patent No.: US 6,463,904 B2
(45) Date of Patent: Oct. 15, 2002

(54) OIL MODULE FOR AN INTERNAL COMBUSTION ENGINE

(75) Inventor: Martin Weindorf, Kornwestheim (DE)

(73) Assignee: Filterwerk Mann & Hummel GmbH, Ludwigsburg (DE)

( * ) Notice: Subject to any disclaimer, the term of this patent is extended or adjusted under 35 U.S.C. 154(b) by 0 days.

(21) Appl. No.: 09/875,270

(22) Filed: Jun. 7, 2001

(65) Prior Publication Data

US 2002/0023612 A1 Feb. 28, 2002

(30) Foreign Application Priority Data

Jun. 7, 2000 (DE) ..... 100 28 159

(51) Int. Cl.[7] ..... F01M 1/00
(52) U.S. Cl. ..... 123/196 R
(58) Field of Search ..... 123/195 A, 196 R, 123/195 C, 198 C, 196 A; 277/549, 551

(56) References Cited

U.S. PATENT DOCUMENTS 4,645,215 A * 2/1987 Fuchs et al. ..... 277/152
6,050,572 A * 4/2000 Balsells et al. ..... 277/551
6,164,660 A * 12/2000 Goodman ..... 277/556
6,250,637 B1 * 6/2001 Oricchio, Jr. ..... 277/321
6,267,094 B1 * 7/2001 Kuettner et al. ..... 123/196 A

FOREIGN PATENT DOCUMENTS

DE 19626867 1/1998
EP 0838577 4/1998

* cited by examiner

*Primary Examiner*—Gene Mancene
*Assistant Examiner*—Hyder Ali
(74) *Attorney, Agent, or Firm*—Crowell & Moring LLP

(57) ABSTRACT

An oil module for an internal combustion engine including a carrier element (10), an oil pump (12) integrated in the carrier element, an oil filter (21) which is flange-mounted to the carrier element, and at least one pressure control valve (17). The carrier element (10) is made of synthetic resin material and covers a flange area of the internal combustion engine. The housing for the oil pump (12) is arranged on the carrier element (10) in the flange area of the internal combustion engine.

7 Claims, 3 Drawing Sheets

OIL MODULE FOR AN INTERNAL COMBUSTION ENGINE

CROSS REFERENCE TO RELATED APPLICATION

This application claims priority under 35 U.S.C. §119 of Federal Republic of Germany patent application no. DE 100 28 159.1, filed Jun. 7, 2000, the entire disclosure of which is incorporated herein by reference.

FIELD OF THE INVENTION

The invention relates to an oil module for an internal combustion engine comprising a carrier element, an oil pump integrated in the carrier element, an oil filter, which is flange-mounted to the carrier element, and a pressure control valve.

BACKGROUND OF THE INVENTION

An oil module of this general type is known, for example, from EP 0 838 577 A1. The oil supply system of an engine described in this document extends along an end face of the engine. It is adjoined by an oil pan with an oil pump, which sucks oil out of the oil pan and at the same time drives the oil circuit to supply the engine with oil. An oil cooler also is provided, which is connected with the coolant circuit and the oil circuit, and which is equipped with an oil filter. The fluid connections between oil module and engine are provided by lines that are integrated into the oil module.

A drawback of this known oil module is that, although a plurality of elements is combined into a module, the arrangement of these elements involves a highly complex arrangement of the lines and thus results in a very complex construction of the module.

Further, DE 196 26 867 discloses a carrier part for the lubricant oil supply and oil treatment elements in an internal combustion engine. This carrier part is intended to accommodate as many of these elements as possible and has seats for an oil filter, an oil cooler, an oil pressure control valve and a bypass duct. In addition, corresponding oil carrying ducts are formed in the carrier part.

A drawback of this carrier part is that a reliable seal is required on the internal combustion engine due to the plurality of the connections. The carrier part itself is not equipped with the individual components, but is only a mounting element for the components. This has the further drawback that leakage problems can occur due to the plurality of mounting points.

SUMMARY OF THE INVENTION

It is an object of the invention is to provide an oil module which obviates the foregoing drawbacks.

Another object of the invention is to provide an oil module for an internal combustion engine, which directly contains a plurality of oil supply components and thus requires only a few sealing locations.

These and other objects are achieved in accordance with the present invention by providing an oil module for an internal combustion engine, comprising a carrier element, an oil pump integrated in said carrier element, an oil filter which is flange-mounted to the carrier element, and at least one pressure control valve, wherein the carrier element is made of synthetic resin material and covers a flange area of the internal combustion engine, and wherein a housing for the oil pump is arranged on the carrier element in the flange area of the internal combustion engine.

In accordance with another aspect of the invention, the objects are achieved by providing a sealing ring made of a thermoplastic synthetic resin material with an injection-molded sealing or dirt lip made of polytetrafluoroethylene and an injection molded silicon seal for axial sealing of a shaft, wherein an assembly sleeve, which pre-positions the sealing lips, is provided for inserting the shaft, and an assembly dummy of the shaft precisely centers the sealing ring on a receiving flange.

The essential advantage of the invention is that the carrier part, which is made of synthetic resin material, i.e. plastic, covers a flange area of the internal combustion engine, and the crankshaft, which directly drives the oil pump integrated into the oil module, extends in the flange area. This achieves a very compact unit. Furthermore, the use of synthetic resin material has the advantage of providing a simple and effective seal, while being inexpensive to produce and having low weight.

According to one embodiment of the invention, the oil filter is a casing oil filter. The casing forms a direct part of the carrier element. Inside the casing oil filter, a metal-free filter cartridge is arranged. Both the incoming unfiltered fluid line and the outgoing filtered fluid line are integrated into the carrier element. After use, the metal-free filter cartridge can be easily replaced and thermally disposed of.

The carrier element of the invention offers a further possibility for integration with respect to the oil cooler. The oil cooler can either be integrated into the carrier element or flange-mounted thereto. The oil pump disposed inside the carrier element is an internal gear pump, which runs inside a flat pressure die cast component made of aluminum. To seal the crankshaft, which extends through the oil module, the oil module has a sealing ring, which is held in a flange and is provided with a sealing lip or dirt lip made of polytetrafluoroethylene (PTFE). Further, an injected silicon seal is provided for axial sealing of the crankcase volume.

The invention further relates to a sealing ring used in the oil module. The sealing ring is pre-positioned by an assembly mock-up of the crankshaft to ensure a precise seat of the seal during final assembly of the oil module and thus a reliable seal of the crankshaft.

These and other features of preferred embodiments of the invention, in addition to being set forth in the claims, are also disclosed in the specification and/or the drawings, and the individual features each may be implemented in embodiments of the invention either individually or in the form of subcombinations of two or more features and can be applied to other fields of use and may constitute advantageous, separately protectable constructions for which protection is also claimed.

BRIEF DESCRIPTION OF THE DRAWINGS

The invention will be described in further detail hereinafter with reference to illustrative preferred embodiments shown in the accompanying drawings in which.

DETAILED DESCRIPTION OF PREFERRED EMBODIMENTS

Figure 1:
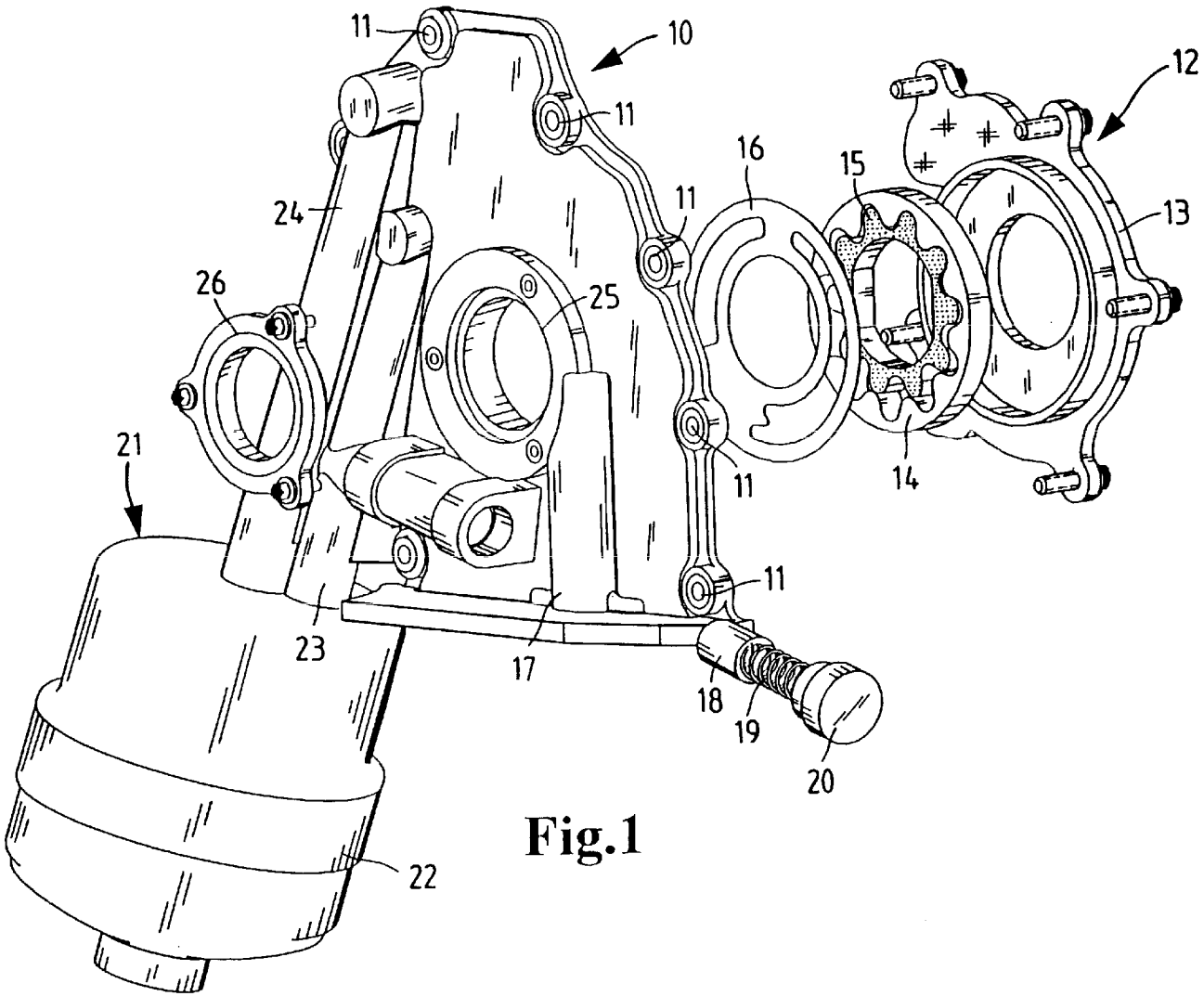
FIG. 1 is a schematic representation of an oil module incorporating the individual components of the invention.

The oil module according to FIG. 1 comprises a carrier part 10, which is provided with mounting bores 11 along its periphery for mounting to the internal combustion engine. An oil pump 12 is integrated into carrier part 10. The oil pump comprises an oil pump housing 13, which may be a pressure cast aluminum part, a rotor set comprising an outer rotor 14 and an inner rotor 15, and a washer or wearing ring 16.

Further, a pressure control valve 17 is arranged on carrier part 10. This pressure control valve is shown with a valve plunger 18, valve spring 19, and plug 20. The valve ensures constant oil pressure in the oil supply line.

Also connected to carrier part 10 is a casing oil filter 21, which is sealed with a cover 22 in a manner known per se. Casing oil filter 21 contains a filter element (not shown), to which the oil to be filtered is supplied by oil pump 12 via line 23. Filtered oil flows via line 24 to the bearings which must be supplied with oil (not shown).

When carrier part 10 is mounted to an internal combustion engine, the crankshaft of the engine is pushed through carrier part opening 25. A shaft sealing ring 26 is screwed onto this opening 25 and provides a reliable seal of the outwardly extending crankshaft, to which pulleys for driving auxiliary units may be mounted in the usual manner.

Figure 2:
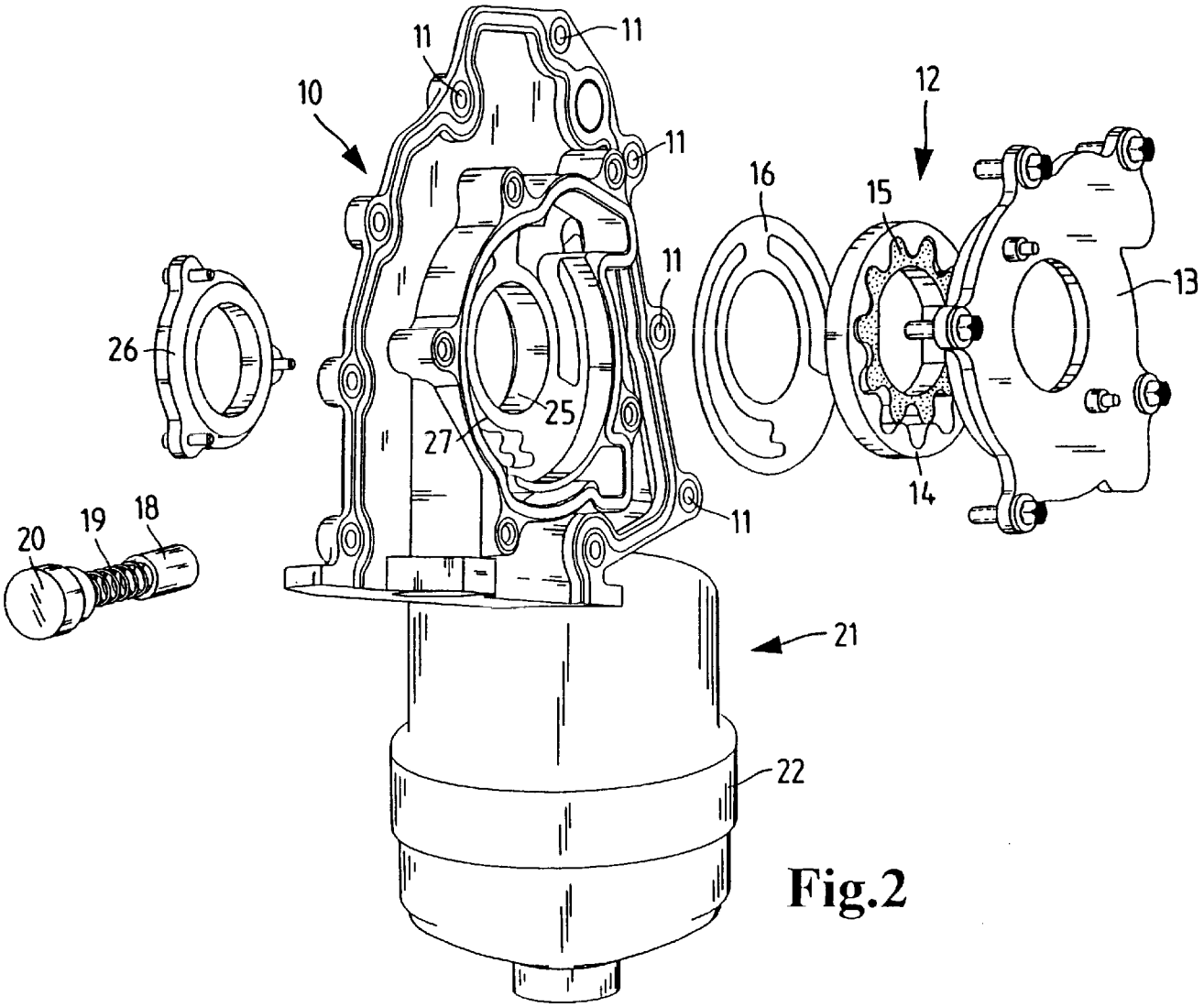
FIG. 2 shows the module depicted in FIG. 1 viewed from the flange side.

FIG. 2 shows the carrier part as viewed from the flange side. Identical parts are provided with the same reference numbers. The parts of the oil pump, such as wearing ring 16 as well as outer rotor 14 and inner rotor 15, are inserted into oil pump housing 13 and are then integrated together with the housing into housing opening 27. The housing opening is provided with ducts for the incoming and pumped oil. The use of synthetic resin material, i.e., injection molded plastic, permits complex housing structures like the one depicted here. Plastic has the further advantage that it reduces the weight of the assembly.

Figure 3:
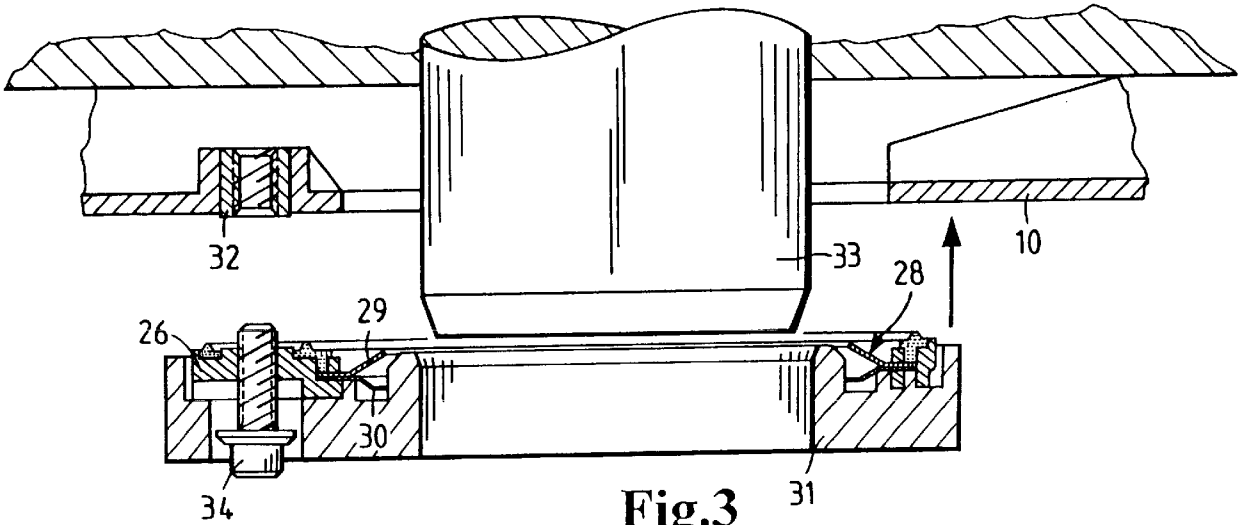
FIG. 3 is a depiction of the preliminary assembly of the sealing ring for the crankshaft, and FIGS. 4*a, b* and *c* are assembly diagrams of the oil module on the internal combustion engine.

FIG. 3 is a section view illustrating the preassembly of a crankshaft sealing ring 28 on carrier part 10. First, the crankshaft sealing ring 28, which comprises a silicon seal 29 and a dirt lip 30 made of polytetrafluoroethylene, is inserted into the shaft sealing ring 26 and centered by using an assembly sleeve 31. Inserts 32 are provided on carrier part 10 for attaching the shaft sealing ring 26.

Further, an assembly mock-up 33 of the crankshaft is first inserted into the carrier part. With the assembly mock-up, the shaft sealing ring 26 is guided to the carrier part 10 and connected therewith by means of bolts 34. After attachment of the sealing ring 26 to the carrier part 10, assembly mock-up 33 and installing sleeve 31 can be removed. The crankshaft sealing ring 28 is precisely aligned to the crankshaft, which is to be mounted later.

Figure 4C:
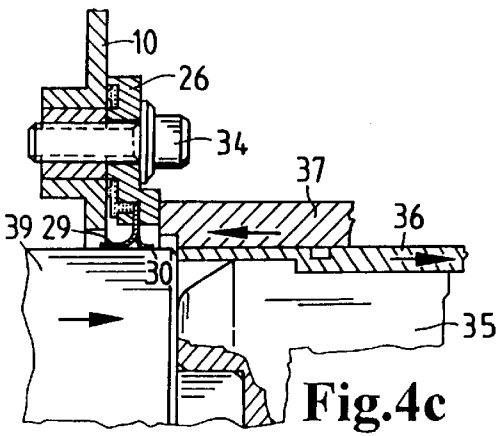
Figure 4B:
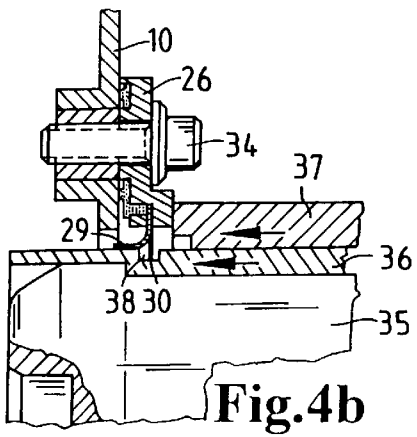
Figure 4A:
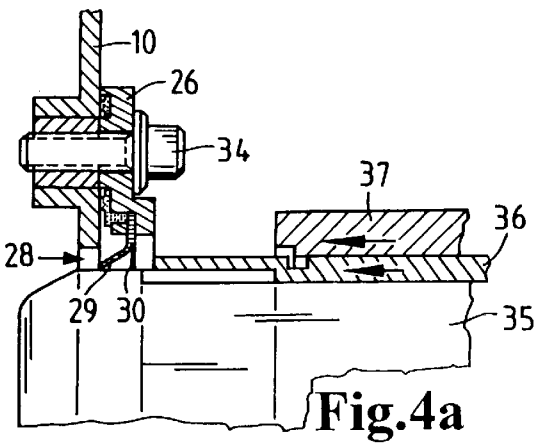

FIG. 4 shows the mounting of the carrier part to the engine. As mentioned above and described in FIG. 3, crankshaft sealing ring 28 is already centered. An expanding mandrel 35 is first pushed into the carrier part. On this expanding mandrel, an expanding sleeve 36 and a positioning sleeve 37 are arranged. The positioning sleeve is pushed up to shaft sealing ring 26 as shown in FIG. 4b. The expanding sleeve is pushed leftward far enough until the dirt lip 30 extends inside a groove 38 of the expanding sleeve.

Now, the crankshaft 39 can be inserted from the left. It moves the expanding mandrel 35 and the expanding sleeve 36 toward the right. As soon as crankshaft sealing ring 28 rests against the crankshaft, the assembly aids can be removed. Thereafter, the carrier part 10 is fastened to the internal combustion engine by means of the screwed connections with the mounting bores 11 shown in FIG. 1.

The foregoing description and examples have been set forth merely to illustrate the invention and are not intended to be limiting. Since modifications of the disclosed embodiments incorporating the spirit and substance of the invention may occur to persons skilled in the art, the invention should be construed broadly to include all variations falling within the scope of the appended claims and equivalents thereof.

What is claimed is:

1. An oil module for an internal combustion engine, comprising a carrier element, an oil pump integrated in said carrier element, an oil filter which is flange-mounted to the carrier element, and at least one pressure control valve, wherein the carrier element is made of synthetic resin material and covers a flange area of the internal combustion engine, wherein a housing for the oil pump is arranged on the carrier element in the flange area of the internal combustion engine, and wherein the internal combustion engine has a crankshaft which extends through the oil module and the oil pump, said crankshaft being provided with an outward sealing ring, said sealing ring being is held in a flange and being provided with a sealing or dirt lip made of polytetrafluoroethylene and with an injection molded silicon seal for axial sealing of the crankshaft.

2. An oil module according to claim 1, wherein the oil filter is a casing oil filter with a metal-free filter cartridge, said oil filter having an unfiltered fluid intake line and a filtered fluid outlet line integrated into the carrier element.

3. An oil module according to claim 1, further comprising an oil cooler through which coolant of the internal combustion engine flows integrated into the carrier element.

4. An oil module according to claim 1, further comprising an oil cooler through which coolant of the internal combustion engine flows flange -mounted to the carrier element.

5. An oil module according to claim 1, wherein the oil pump is an internal gear pump, which is integrated into a flange-shaped, flat, pressure die cast aluminum part inside the carrier element.

6. A sealing ring made of a thermoplastic synthetic resin material with an injection-molded sealing or dirt lip made of polytetrafluoroethylene and an injection molded silicon seal for axial sealing of a shaft, wherein an assembly sleeve, which pre-positions the sealing lips, is provided for inserting the shaft, and an assembly dummy of the shaft precisely centers the sealing ring on a receiving flange.

7. A sealing ring according to claim 6, in combination with an oil module for an internal combustion engine, comprising a carrier element, an oil pump integrated in said carrier element, an oil filter which is flange-mounted to the carrier element, and a pressure control valve, wherein the carrier element is made of synthetic resin material and covers a flange area of the internal combustion engine; a housing for the oil pump is arranged on the carrier element in the flange area of the internal combustion engine; said shaft is a crankshaft of the internal combustion engine, and said sealing ring receives and seals said crankshaft.

* * * * *